US005667349A

United States Patent [19]

Turchin et al.

[11] Patent Number: 5,667,349

[45] Date of Patent: Sep. 16, 1997

[54] METHOD OF MAKING PULL TABS AND LUBRICANT THEREFOR

[75] Inventors: Henry Turchin, Loveland; Cindy S. Dinevski, Cincinnati; Kevin H. Tucker, Blanchester, all of Ohio

[73] Assignee: Cincinnati Milacron Inc., Cincinnati, Ohio

[21] Appl. No.: 427,932

[22] Filed: Apr. 26, 1995

[51] Int. Cl.[6] ..... C10M 137/04; C10M 141/10

[52] U.S. Cl. ..... 413/25; 508/174; 508/429; 508/431

[58] Field of Search ..... 508/174, 429, 508/431; 413/25

[56] References Cited

U.S. PATENT DOCUMENTS

| | | | |
|---|---|---|---|
| 2,625,509 | 1/1953 | Laug | 508/174 |
| 2,825,693 | 3/1958 | Beaubien et al. | 508/174 |
| 2,831,782 | 4/1958 | Zvanut | 508/174 |
| 3,868,919 | 3/1975 | Schrecker et al. | 113/121 |
| 3,884,382 | 5/1975 | Ball | 220/272 |
| 4,106,422 | 8/1978 | Buhrke | 113/121 |
| 4,758,359 | 7/1988 | Kirk et al. | 508/174 |
| 4,848,623 | 7/1989 | Saunders et al. | 220/273 |
| 4,950,415 | 8/1990 | Malito | 252/56 |
| 4,978,465 | 12/1990 | Sturwold | 252/48.4 |
| 5,125,212 | 6/1992 | Smyth | 53/412 |

*Primary Examiner*—Jerry D. Johnson

*Attorney, Agent, or Firm*—John W. Gregg; Donald Dunn

[57] ABSTRACT

An improved process for making metallic pull tabs is provided. In accordance with the improved pull tab making process comprising the steps of feeding a strip of metal into a pull tab forming die and forming the metallic pull tab the step of forming the pull tab is carried out in the presence of an aqueous based lubricant composition comprising water, an alkaline pH producing substance selected from the group consisting of alkali metal hydroxides, water soluble or dispersible aliphatic amines and water soluble or dispersible hydroxyl substituted aliphatic amines, an emulsifier, a water soluble or dispersible alpha (p-nonylphenyl) omega hydroxypoly (oxyethylene) phosphate ester and a water soluble or dispersible aliphatic diol.

21 Claims, No Drawings

METHOD OF MAKING PULL TABS AND LUBRICANT THEREFOR

FIELD OF INVENTION

This invention relates to methods of making metallic pull tabs used in the production of metallic food containers, particularly beverage containers such as for example for beer and carbonated beverages. More especially this invention relates to methods of making metallic pull tabs employing a lubricant having a low volatile organic content (VOC) and to such lubricants. Additionally this invention relates to methods of making metallic pull tabs using an aqueous based lubricant or machining fluid having a low VOC.

BACKGROUND

Many metallic food containers (i.e. cans), for the distribution of food, have a metallic pull tab attached to one end for ease of opening to deliver contents of the can. Examples of such common cans include beer and soda pop cans. The metallic pull tab provides a convenient finger grasping means for opening the can. Typically these metallic pull tabs are riveted to metallic can ends or lids that are subsequently secured to a metallic can body containing the food stuff. These metallic pull tabs are produced in very large quantities on presses that are operated continuously, except for breakdowns, maintenance, tooling changes or tooling replacement. To reduce tooling (i.e. die) replacement due to wear it is conventional for the press operators to employ lubricants in the metallic pull tab making process. The metallic pull tab making process generally involves progressively feeding a strip of metal (e.g. aluminum or steel) into a series of dies, each of which performs a specific forming operation in a series of steps to produce the metallic pull tabs. The dies are known to be expensive and their removal for replacement or reconditioning increases, through lost production, the cost of pull tabs produced with a particular die. Thus it is highly desirable to maximize the number of parts produced before the dies must be reconditioned or replaced due to wear. To maximize die life and usage and reduce press downtime it is known in the metallic pull tab process art to employ a lubricant. Such a lubricant may be coated onto the metallic strip prior to the strip being fed into the presses for making pull tabs.

Conventionally two types of lubricants have been employed in the prior art process for making metallic pull tabs. One type is a lubricating substance dissolved in an organic solvent, usually a volatile organic solvent. The solution is applied to a metal strip from which pull tabs will be produced. On evaporation of the solvent, a residue of lubricant is left on the metallic strip. An example of such a prior art lubricant is butyl stearate dissolved in a solvent such as an alcohol. This type of lubricant and the pull tabs making process employing it is disadvantageous because it releases a volatile organic compound or substance (i.e. the solvent) into the atmosphere which may cause pollution problems as well as health and safety hazards. The release of volatile organic compounds into the atmosphere is of significant concern and is subject to government regulations (e.g. Clean Air Act) which increasingly restrict or eliminate the introduction of volatile organic compounds into the air. Further use of volatile solvents may be required to remove the lubricant residue from the finished product, increasing the use thereof to produce containers free of such residue. Thus the volatile organic content (VOC) of lubricants employed for making metallic pull tabs has been increasingly subject to restriction and disfavor. To overcome this problem a second type of lubricant, described in U.S. Pat. No. 5,125,212, has been produced and used in the metallic pull tab making process. This lubricant provides a very low or zero VOC and is a combination of mineral oil and butyl stearate. Essentially this second type of lubricant has replaced the volatile organic substance with a non volatile or low volatile substance, namely mineral oil, as a carrier for the butyl stearate. While the lubricant composition of mineral oil and butyl stearate provides a low VOC lubricant, mineral oil is known to mist (i.e. form very fine droplets suspended in air). Such mists coat machine parts with an oily residue that is often difficult and time consuming to remove and which traps other material (i.e. metal particles) which can cause wear problems on the machine. Non-aqueous (i.e. oil) based lubricant composition used in prior art pull tab making processes are often difficult to completely remove from the metallic pull tab during the tab making process or by washing and thus leave a residue on the pull tab. Further, residual mineral oil butyl stearate lubricant composition on the metallic pull tabs may have adverse effects on some properties of the food contents of the can, for example the foaming properties of beer and carbonated beverages such as soda pop, when transferred to the underside of the metallic pull tabbed lid or end for the can. It is also known that oil based lubricants can present fire hazards and disposal problems.

It is known for metallic pull tabs made in prior art pull tab making processes using prior art lubricants to leave a small residual amount of lubricant on the pull tab. Typically lids or ends, with these pull tabs attached, are stacked one upon another with the pull tab (top) side of the lid contacting the opposite (bottom) side of the lid above it. This stacking causes transfer of some of the residual lubricant from the pull tab on one lid or end to the bottom side of the lid or end above it in the stack. The lid or end having a small amount on the underside is then attached to (i.e. used to close) a metallic can containing food stuff and the food stuff can then contact the lubricant on the lid. Typically the lubricant is composed of food safe materials (i.e. materials that are safe for and approved for food contact) and does not usually present a food safety problem. However, prior art lubricants have been known to be able to adversely affect certain properties of the food stuff contents of the can. One example of such affect is the known adverse effect a lubricant may have on the foam stability of beer and carbonated beverages such as soda pop. Beers are often known and judged on the head (layer of foam) they produce when poured. Hence, it is undesirable for the beer container to adversely affect or cause collapse of the head of the beer. Therefore, can producers employ a foam collapse test which must be passed by lubricant compositions they use. In addition to passing this test, the lubricant composition must meet other requirements for food contact as well as lubrication properties. Similar problems also occur with soda pop. Any lubricant present on the interior of the lid of a beer can that would and does cause instability (i.e. reduced stability) of the head of poured beer or the foam of soda pop is undesirable. Pull tab cans used for beer and soda pop constitute a very significant percentage of the total pull tab cans produced and sold. The art therefore constantly seeks pull tab making processes using lubricants that promote: maximum tool life; maximum utilization of the pull tab making apparatus; very little or no atmospheric or other environmental pollution; low health and safety hazards; and little and preferably no adverse effects on the behavior or properties of the food contents of the can.

SUMMARY OF INVENTION

This invention overcomes many of the disadvantages of prior art metallic pull tab making processes using non-aqueous lubricants compositions and provides a metallic pull tab making process employing an aqueous based lubricant composition.

It is therefore an object of this invention to provide a metallic pull tab making process employing an aqueous based lubricant composition that promotes little or no atmospheric pollution by the lubricant composition.

Another object of this invention is to provide a metallic pull tab making process employing an aqueous based lubricant composition that promotes long tool life for the pull tab producing equipment.

A further object of this invention is to provide a metallic pull tab making process using an aqueous based lubricant composition that has little or no adverse effects on the behavior or properties of food which may be contacted incidentally by residue of such lubricant left on container ends in the process of their manufacture.

A still further object of this invention is to provide a metallic pull tab making method using an aqueous based lubricant composition that produces metallic pull tabs especially suited for use on metallic lids for closing metallic cans containing beer or soda pop.

These and other objects, as will become apparent to one skilled in the art from the following description and claims, are achieved by this invention providing a pull tab making process comprising stepwise forming a metallic pull tab in the presence of an aqueous based lubricant composition comprising a) water, b) an alkaline pH producing substance selected from the group consisting of alkali metal hydroxides, water soluble or dispersible unsubstituted aliphatic amines and water soluble or dispersible hydroxyl substituted amines, c) an emulsifier, d) a water soluble or dispersible alpha (p-nonylphenyl) omega hydroxypoly (oxyalkylene) phosphate ester and e) a water soluble or dispersible aliphatic diol. This invention in one aspect provides a method of making metallic pull tabs suited for use on metallic cans for containing food stuff. In another, more particular aspect, this invention provides a method for making metallic pull tabs for use on metallic cans to contain beer or soda pop.

DESCRIPTION OF INVENTION

The process of making metallic pull tabs is known generally to involve coating both sides (i.e. top and bottom faces) of a strip of metal, usually aluminum or steel, with a lubricant composition. Where the lubricant composition contains a volatile organic solvent, as in some prior art compositions, the solvent is evaporated to leave a residue of a lubricant substance on the surfaces of the strip of metal prior to the strip being formed into the pull tab. One prior art example of such a volatile organic solvent containing lubricant composition used to make metallic pull tabs is butyl stearate dissolved in an alcohol. The alcohol is evaporated leaving the butyl stearate on the strip of metal as a lubricant substance. Where the lubricant composition does not contain a volatile organic solvent, such as for example the mineral oil and butyl stearate lubricant composition disclosed in U.S. Pat. No. 5,125,212, the entire lubricant composition remains on the metallic strip as the strip is fed into dies for forming the pull tab. The lubricant coated strip of metal is then progressively fed into a series of dies that progressively form the pull tabs from the strip at high speed. The lubricant substance or composition on the metallic strip reduces the friction between the strip and the die to protect the die from wear. Ideally, all of the lubricant substance or composition on the portion of the metallic strip formed into a pull tab is used up in the pull tab forming operation in accordance with prior art pull tab making methods. These pull tabs are then attached (e.g. riveted) to metallic can ends that are then stacked one upon the other with the pull tabbed side of one can end contacting the under side of the pull tabbed can end above it. These tabbed metallic can ends are subsequently used to close cans (generally metallic cans). In the pull tab making process itself the lubricant substance or composition not only protects the dies against wear but also protects the metallic strip from scoring and tearing during the forming of the pull tab. However, in the process for manufacture of can ends with pull tabs, lubricant residue may be transferred from the pull tabs to the can ends and to the sides thereof which will be inside containers closed by the ends.

Although pull tabbed cans, whether they be made of metal or some other material, may be employed to hold a wide variety of materials (e.g. oil and food). Pull tabbed cans for holding food constitute a very large portion of pull tabbed cans made and used. In respect to food holding pull tabbed metallic cans a very large percentage of such cans are employed to hold beverages such as for example beer and carbonated beverages such as soda pop. Since it is known for a lubricant substance or composition used to make metallic pull tabs to be transferred to the interior or bottom of a metallic lid or end, it is essential that the lubricant substance or composition used in making the pull tabs be safe for contact with food stuffs to be contained using such lids. Desirably and importantly in the case of pull tabbed beer and soda pop cans any residual lubricant substance or composition coming in contact with the beer or soda pop should not only be safe for contact with food but also should have very little if any adverse affect on the behavior or properties (e.g. foaming) of the beer or soda pop. In accordance with one embodiment of this invention for an improved pull tab making process there is employed an aqueous lubricant composition comprising components that are safe for contact with food, and itself being safe for contact with food, while at the same time having little or no adverse affect on the properties of food stuff, particularly beer and soda pop.

There is now provided in accordance with this invention an improved pull tab making process comprising the steps of feeding a metallic strip or band into a pull tab forming die and forming a metallic pull tab, the improvement comprising applying to the metallic strip or band an aqueous based lubricant composition comprising:

a) water;

b) an alkaline pH producing substance selected from the group consisting of alkali metals, water soluble or dispersible aliphatic amines and water soluble or dispersible hydroxyl substituted aliphatic amines;

c) an emulsifier;

d) a water soluble or dispersible alpha (p-nonylphenyl) omega hydroxypoly (oxyalkylene) phosphate ester and e) a water soluble or dispersible aliphatic diol.

In accordance with one practice of this invention there is provided an improved pull tab making process comprising the steps of feeding a metallic strip or band into a pull tab forming die and forming a metallic pull tab, the improvement comprising applying to the metallic strip or band an aqueous based lubricant composition comprising:

a) water;

b) a water soluble or dispersible hydroxyl substituted aliphatic amine;

c) an emulsifier;

d) a water soluble or dispersible alpha (p-nonylphenyl) omega hydroxypoly (oxyalkylene) phosphate ester and e) a water soluble or dispersible aliphatic diol.

There is provided in accordance with another practice of this invention an improved pull tab making process comprising the steps of feeding a metallic strip or band into a pull tab forming die and forming a metallic pull tab, the improvement comprising applying to the metallic strip or band an aqueous based lubricant composition comprising;

a) water;

b) a water soluble or dispersible aliphatic amine;

c) an emulsifier;

d) a water soluble or dispersible alpha (p-nonylphenyl) omega hydroxypoly (oxyalkylene) phosphate ester and e) a water soluble or dispersible aliphatic diol.

In a further practice of this invention there is provided an improved pull tab making process comprising the steps of feeding a strip or band of metal into a pull tab forming die and forming a metallic pull tab, the improvement comprising applying to the strip or band of metal an aqueous based lubricant composition comprising;

a) water;

b) a water soluble or dispersible hydroxyl substituted aliphatic amine;

c) an emulsifier;

d) a water soluble or dispersible alpha (p-nonylphenyl) omega hydroxypoly (oxyethylene) phosphate ester and e) a water soluble or dispersible aliphatic diol.

There is provided in accordance with a still further aspect of this invention an improved pull tab making process comprising the steps of feeding a metallic strip or band into a pull tab forming die and forming a metallic pull tab, the improvement comprising applying to the metallic strip or band an aqueous based lubricant composition comprising;

a) water; b) a water soluble or dispersible hydroxyl substituted aliphatic amine;

c) alpha (p-nonylphenyl) omega hydroxypoly (oxyethylene) mixture of dihydrogen and monohydrogen phosphate esters;

d) a water soluble or dispersible ethoxylated sorbitan monostearate and e) a water soluble or dispersible aliphatic diol.

Water soluble or dispersible aliphatic amines used in the aqueous based lubricant composition in accordance with this invention include monoamines, diamines, polyamines, primary amines, secondary amines, tertiary amines and straight and branched chain aliphatic amines. Examples of such amines include, but are not limited to ethyl amine, propyl amine, 2-ethyl butyl amine, ethylene diamine, butylene diamine, 1,2-propylene diamine, 1,3-propylene diamine, diethyl amine, N-methyl butyl amine, triethylamine, dimethylamino propylamine, diethylene triamine, tetraethylene pentamine and polyoxyethylene diamine. Water soluble or dispersible hydroxyl substituted aliphatic amines usable in the practice of this invention include hydroxyl substituted monoamines, hydroxyl substituted diamines, hydroxypolyoxyalkylene amines, primary amines, secondary amines and tertiary amines. Examples of such hydroxyl substituted aliphatic amines include, but are not limited to, ethanolamine, propanolamine, octanolamine, diethanolamine, triethanolamine, N-methylethanolamine, N,N-dimethylethanolamine, N-aminoethyl ethanolamine and hydroxypolyoxyethylene amine. The principal criteria for the aliphatic amine and hydroxyl substituted aliphatic amine usable in the aqueous based lubricant composition in accordance with the method of this invention is that the amine a) produce an alkaline Ph in the lubricant composition and b) is water soluble or dispersible. It is also important that the amine be compatible with the other components of the aqueous based lubricant composition. Hydroxyl substituted aliphatic amines are preferred in the practice of this invention.

The emulsifier usable in the aqueous based lubricant composition in accordance with the method of this invention may be a cationic, anionic or nonionic emulsifier. The term emulsifier as employed in this description and the appended claims is intended to include and be synonymous with the terms surfactant and surface active agent. Examples of emulsifiers include but are not limited to alkali metal salts of alkyl aryl sulfonic acids, sodium dialkyl sulfosuccinate, sulfated caster oil, sulfonated tallow, sodium lauryl sulfate, oleylamine acetate, cetylamine acetate, di-dodecylamine lactate, dilauryl triethylene tetramine diacetate, 1-aminoethyl-2-heptadecenyl imadazoline acetate, cetyl pyridinium bromide, hexadecyl ethyl morpholinium chloride, di-ethyl-di-dodecyl ammonium chloride, tetraethyleneglycol monopalmitate, hexaethyleneglycol monolaurate, nonaethyleneglycol monostearate, nonaethyleneglycol dioleate, tetradecylethyleneglycol monoarachidate, tricosaethyleneglycol dibehenate, polyoxyethylene monolaurate, polyoxyethylene glycol monopalmitate, polyoxyethylene cetyl ether, polyoxyethylene tridecyl ether, polyoxyethylene oleyl ether, polyoxyethylene stearyl ether, sorbitan tristearate and alkoxylated sorbitan fatty acid esters. Water soluble or dispersible alkoxylated sorbitan fatty acid ester emulsifiers are preferably used in the aqueous based lubricant composition in the practice of the method of this invention. These emulsifiers include, but are not limited to, the polyoxyethylene homopolymer, polyoxyethylene/polyoxypropylene random and block copolymers, oxyethylene capped polyoxypropylene homopolymer and polyoxypropylene homopolymer derivatives of the sorbitan fatty acid esters such as for example including, but not limited to, the sorbitan fatty acid esters of oleic acid, stearic acid, lauric acid and palmitic acid, polyoxethylene sorbitan monolaurate, polyoxyethylene sorbitol hexaoleate, polyoxyethylene sorbitol lanolin derivative, polyoxyethylene sorbitan monostearate, polyoxyethylene sorbitan monooleate and polyoxyethylene sorbitan monopalmitate. Alkoxylated sorbitan monostearate is preferred and ethoxylated sorbitan monostearate is especially preferred. Important features of the emulsifier are that it forms stable emulsions and it is compatible with other components of the aqueous based lubricant compositions.

Water soluble or dispersible aliphatic diols usable in the aqueous based lubricant composition in the practice of the method of this invention include straight chain, branched chain and polyoxyalkylene diols, examples of which include, but are not limited to, ethylene glycol, dipropylene glycol, diethylene glycol, triethylene glycol, 2-methyl-2-ethyl-1,3-propane diol, polyoxyethylene glycol and polyoxypropylene glycol. Dipropylene glycol is the preferred aliphatic diol for use in the aqueous based lubricant composition in accordance with the method of this invention. Water solubility or dispersibility and compatibility with other components of the aqueous based lubricant composition are important characteristics for the aliphatic diol.

The water soluble or dispersible alpha (p-nonylphenyl) omega hydroxypoly (oxyalkylene) phosphate esters usable in the aqueous based lubricant composition in the practice of the method of this invention include, but are not limited to alpha (p-nonylphenyl) omega hydroxypoly (oxyethylene) phosphate esters. Preferable alpha (p-nonylphenyl) omega hydroxypoly (oxyethylene) mixtures of nonohydrogen and dihydrogen phosphate esters, more preferably poly (oxy-1, 2 ethanediyl) alpha (nonylphenyl) omega hydroxy phosphate, is used in the aqueous based lubricant composition in the practice of the method of this invention. Poly (oxy-1, 2 ethanediyl) alpha (nonylphenyl) omega hydroxy phosphate, is obtainable as LUBROPHOS LE 700 from Rhone-Poulenc Inc. LUBROPHOS is a registered trademark of Rhone-Poulenc Inc.

In the preferred practice of this invention the aqueous based lubricant composition and the components thereof are safe for contact with food stuff, particularly food stuff for human consumption. Thus in a preferred practice of this invention the alkaline pH producing substance, the emulsifier, the alpha (p-nonylphenyl omega hydroxypoly (oxyalkylene) phosphate ester and the aliphatic diol are all to be food safe substances or materials. In an even more preferred practice of this invention the aqueous based lubricant composition and components thereof employed in the manufacture of pull tabs are food safe and have very little or no adverse affect on the foaming and other properties or characteristics of beer and soda pop.

The concentrations of water, alkaline pH producing substance, emulsifier, alpha (p-nonylphenyl) omega hydroxypoly (oxyalkylene) phosphate ester and aliphatic diol of the aqueous based lubricant composition employed in the method of this invention may vary over a wide range. Such variations in concentration may be necessitated by, among other things, the specific materials employed in the aqueous based lubricant composition as well as the operating conditions for the equipment used in the pull tab making process (e.g. the speed at which the pull tabs are formed and the metal being used to make the pull tabs). A water concentration of from about 10% to about 95%, preferably 25% to 75%, by weight based on the total composition of the aqueous based lubricant may be employed. The alkaline pH producing substance may be present in a concentration of from about 1% to about 10%, preferably 2% to 8%, by weight based on the total composition of the aqueous based lubricant. An alpha (p-nonylphenyl) omega hydroxypoly (oxyalkylene) phosphate ester concentration of from about 1% to about 10%, preferably 2% to 7%, by weight based on the total composition of the aqueous based lubricant may be employed. The emulsifier may be present in a concentration of from about 2% to 10%, preferably 3% to 7%, by weight based on the total composition of the aqueous based lubricant. There may be used an aliphatic diol concentration of from about 2% to about 10%, preferably 3% to 8%, by weight based on the total composition of the aqueous based lubricant.

In the preferred practice of this invention there is provided an improved pull tab making process comprising the steps of feeding a metallic strip or band into a pull tab forming die and forming a metallic pull tab, the improvement comprising applying to the metallic strip or band an aqueous based lubricant composition comprising;

a) water b) triethanolamine;

c) poly(oxy-1,2-ethanediyl) alpha (nonylphenyl) omega hydroxy phosphate;

d) ethoxylated sorbitan monostearate having 20 moles of ethyoxy groups and e) dipropylene glycol.

A variety of methods may be employed in providing the aqueous based lubricant composition at the interface between the metallic strip and the pull tab forming die in the practice of the method in accordance with this invention. Thus for example the aqueous based lubricant composition of the method of this invention may be a) coated onto one or both sides of the metallic strip by, for example, spraying, roller coating, dipping and brushing, prior to the step of feeding the metallic strip into a pull tab forming die, b) coated onto one or both sides of the metallic strip, by for example spraying, roller coating and brushing, simultaneously with the step of feeding the metallic strip into the pull tab forming die or c) fed to the interface between the metallic strip and the pull tab forming die continuously with the step of forming the metallic pull tab. Although the water in the aqueous based lubricant composition coated onto the metallic strip prior to feeding the metallic strip into the pull tab forming die may be evaporated to leave a lubricant composition residue comprising the remaining components of the aqueous based lubricant composition on the metallic strip being fed into the pull tab forming die in the practice of the method of this invention it is not necessary to carry out such evaporation of the water in the practice of the method of this invention. It is contemplated in the practice of this invention that all the components of the aqueous based lubricant composition are water soluble or dispersible materials. In the preferred practice of this invention the aqueous based lubricant composition and components thereof are safe for contact with food stuff. Therefore, lids having attached thereto pull tabs made with such lubricants need not have the residue of such aqueous based lubricant composition removed prior to closing food containers with such lids. However the aqueous based lubricant composition and the components thereof employed in accordance with the method of this invention and any residue of such lubricant may advantageously be removed by a water wash or rinse. This ability of the aqueous based lubricant composition and components thereof in accordance with the method of this invention to be removed from various surfaces by a water wash or rinse provides a distinct advantage of the method of this invention over prior art pull tab making processes employing non- aqueous lubricants and lubricant compositions requiring non- aqueous washes or rinses to remove the lubricant or lubricant composition from various surfaces including pull tabs. Further it is recognized that fire and safety hazards are reduced, air pollution by organic substances is reduced and disposal problems are reduced advantageously by the method of this invention over prior art pull tab making processes employing non-aqueous based lubricant compositions.

Various water soluble or dispersible additives may be employed in the aqueous based lubricant composition in accordance with the method of this invention for controlling, for example foaming of, corrosion by and micro-organism attack on the aqueous based lubricant composition. These additives are known in the art and may be used in amounts conventionally employed in aqueous based lubricant composition. Preferably these additives are materials safe for contact with food stuff. Some or all of these additives may or may not be necessary in the aqueous based lubricant composition in the method of this invention. Antifoaming agents, corrosion inhibitors and antimicrobial agents well known in the art of aqueous based lubricant compositions are among such additives which may or may not be used in the aqueous based lubricant composition in the practice of the pull tab making process in accordance with this invention.

In a practice of this invention there is provided a pull tab making process comprising the steps of coating both sides of an aluminum strip with an aqueous based lubricant composition, feeding the coated aluminum strip into a pull tab forming die and forming an aluminum pull tab, wherein the aqueous based lubricant composition contains % by weight

| | |
|---|---|
| a) water | 75.0 |
| b) triethanolamine | 5.0 |
| c) poly(oxy-1,2 ethanediyl) alpha (nonylphyl) omega hydroxy phosphate | 5.0 |
| d) ethoxylated sorbitan monostearate having 20 moles of ethoxy groups | 5.0 |
| e) dipropylene glycol | 10.0 |

This invention has been described above with respect to various specific practices thereof. It will be recognized by those skilled in the art that other practices of this invention may exist as would be within the scope of the invention described herein and claimed in the appended claims.

What is claimed is:

1. In an improved metallic pull tab making process comprising the steps of feeding a strip of metal into a pull tab forming die and forming a metallic pull tab, the improvement comprising applying to said strip an aqueous based lubricant composition comprising:

a) water;

b) an alkaline pH producing substance selected from the group consisting of alkali metal hydroxides, water soluble or dispersible aliphatic amines and water soluble or dispersible hydroxyl substituted aliphatic amines;

c) an emulsifier;

d) a water soluble or dispersible alpha (p-nonylphenyl) omega hydroxypoly (oxyethylene) phosphate ester and e) a water soluble or dispersible aliphatic diol.

2. The process in accordance with claim 1 wherein the alkaline pH producing substance is an alkali metal hydroxide.

3. The process in accordance with claim 1 wherein the alkaline pH producing substance is a water soluble or dispersible aliphatic amine.

4. The process according to claim 3 wherein the emulsifier is an alkoxylated sorbitan fatty acid.

5. The process according to claim 3 wherein the aqueous based lubricant composition and the components thereof are food safe.

6. The process in accordance with claim 3 wherein the alpha (p-nonylphenyl) omega hydroxypoly (oxyethylene) phosphate ester is an alpha (p-nonylphenyl) omega hydroxypoly (oxyethylene) mixture of dihydrogen and monohydrogen phosphate esters.

7. The process of claim 6 wherein the emulsifier is an alkoxylated sorbitan fatty acid ester.

8. A process according to claim 1 wherein the alkaline pH producing substance is a hydroxyl substituted aliphatic amine.

9. The process of claim 8 wherein the emulsifier is an alkoxylated sorbitan fatty acid ester.

10. The process according to claim 8 wherein the aqueous based lubricant composition and components thereof are food safe.

11. The process in accordance with claim 8 wherein the alpha (p-nonylphenyl) omega hydroxypoly (oxyethylene) phosphate ester is an alpha (p-nonylphenyl) omega hydroxypoly (oxyethylene) mixture of dihydrogen and monohydrogen phosphate esters.

12. The process according to claim 11 wherein the emulsifier is an alkoxylated sorbitan fatty acid ester.

13. The process according to claim 12 wherein the alkoxylated sorbitan fatty acid ester is an ethoxylated sorbitan fatty acid ester.

14. A process according to claim 1 further comprising the step of coating the strip of metal with the aqueous based lubricant composition prior to the step of feeding the strip of metal into a pull tab forming die.

15. A process according to claim 1 further comprising the step of feeding the aqueous based lubricant composition into the interface between the strip of metal and the pull tab forming die simultaneously with the step of forming the metallic pull tab.

16. The process according to claim 1 wherein the strip of metal is a strip of aluminum.

17. The process according to claim 1 wherein the strip of metal is a strip of steel.

18. A process according to claim 1 further comprising the step of evaporating the water from the aqueous based lubricant composition applied to the strip of metal.

19. In an improved metallic pull tab making process comprising the steps of feeding a strip of metal into a pull tab forming die and forming the metallic pull tab, the improvement comprising applying to said strip an aqueous based lubricant composition comprising;

a) water;

b) triethanolamine;

c) poly(oxy-1,2-ethanediyl) alpha (nonylphenyl) omega hydroxy phosphate;

d) ethoxylated sorbitan monostearate having 20 moles of ethoxy groups and e) dipropylene glycol.

20. A process according to claim 19 wherein the strip of metal is a strip of aluminum.

21. A process according to claim 19 further comprising the step of coating the strip of metal with the aqueous based lubricant composition.

* * * * *